US005248434A

United States Patent [19]

Nicholson

[11] Patent Number: 5,248,434

[45] Date of Patent: Sep. 28, 1993

[54] LIQUID OR GEL BLEACHING COMPOSITION CONTAINING AMIDOPEROXYACID BLEACH AND PERFUME

[75] Inventor: William J. Nicholson, Morrow, Ohio

[73] Assignee: The Proctor & Gamble Company, Cincinnati, Ohio

[21] Appl. No.: 870,989

[22] Filed: Apr. 20, 1992

[51] Int. Cl.[5] ..... C11D 3/395; C11D 3/50; C11D 7/18; C11D 7/54

[52] U.S. Cl. ..... 252/95; 252/102; 252/174.11

[58] Field of Search ..... 252/95, 102, 174.11

[56] References Cited

U.S. PATENT DOCUMENTS

| | | | |
|---|---|---|---|
| 4,113,645 | 9/1978 | DeSimone | 252/95 |
| 4,579,677 | 4/1986 | Hooper | 252/95 |
| 4,634,551 | 1/1987 | Burns et al. | 252/102 |
| 4,663,068 | 5/1987 | Hagemann et al. | 252/99 |
| 4,686,063 | 8/1987 | Burns | 252/102 |
| 4,909,953 | 3/1990 | Sadlowski et al. | 252/99 |
| 4,923,631 | 5/1990 | Sims et al. | 252/186.42 |
| 5,055,218 | 10/1991 | Getty et al. | 252/94 |
| 5,075,027 | 12/1991 | Dixit | 252/174.11 |
| 5,089,162 | 3/1992 | Rarlsarda | 252/102 |
| 5,160,655 | 11/1992 | Donker | 252/95 |

FOREIGN PATENT DOCUMENTS 332259 9/1989 European Pat. Off. .

*Primary Examiner*—Dennis Albrecht
*Attorney, Agent, or Firm*—Ken K. Patel; Donald E. Hasse; Ronald L. Hemingway

[57] ABSTRACT

Liquid or gel bleaching compositions, preferably for laundry use, containing amidoperoxyacid bleach and selected perfume ingredients having good stability when in direct contact with the bleach.

7 Claims, No Drawings

LIQUID OR GEL BLEACHING COMPOSITION CONTAINING AMIDOPEROXYACID BLEACH AND PERFUME

TECHNICAL FIELD

This invention relates to liquid or gel bleaching compositions containing amidoperoxyacid bleach and selected perfume ingredients that have good stability when in direct contact with the bleach, such as when a perfume one or more of the ingredients is mixed directly a composition containing the bleach. The compositions are used for cleaning or bleaching of laundry, but can be used for cleaning or bleaching of hard surfaces.

BACKGROUND OF THE INVENTION

Perfumes are a desirable part of the laundry process. They are used to cover up the chemical odors of the cleaning ingredients and provide an aesthetic benefit to the wash process and, preferably, the cleaned fabrics. Perfumes are often added directly to laundry compositions, such as by spraying the perfume onto or mixing it into finished compositions. However, perfumes generally are volatile and many perfume ingredients can be destroyed or damaged by contact with cleaning ingredients, especially alkali and bleaches. To minimize direct contact between perfume and bleach components in granular compositions, bleaches are sometimes admixed after perfume spray-on. Even this does not avoid oxidation of perfumes by bleaches, particularly when reactive bleaches such as peroxyacids are present, at least partly because of perfume mobility in the compositions. Perfuming liquid and gel compositions containing peroxyacid bleach is even more difficult because of the direct contact between the perfume and bleach.

One solution to this incompatibility problem is encapsulation of the perfume. This increases the expense and complexity of formulation and does not always provide sufficient protection.

European Patent Application 332,259, published Sep. 13, 1989, discloses granular detergent or bleaching compositions containing peroxyacid bleach, including amidoperoxyacids, and perfumed silica particles which separate and protect the perfume from oxidation by the bleach.

U.S. Pat. Nos. 4,634,551, Burns et al, issued Jan. 6, 1987, 4,686,063, Burns, issued Aug. 11, 1987, and 4,909,953, Sadlowski et al, issued Mar. 20, 1990, disclose amidoperoxyacid bleaches useful in the present invention. These compositions can include other ingredients such as perfumes, but no specific perfume ingredients are mentioned.

U.S. Pat. No. 4,023,631, Sims et al, issued May 8, 1990, discloses bleach and/or detergent compositions containing peracid bleach and perfume ingredients which do not contain alkenyl or alkynyl groups and have peracid stability values of at least 65%.

Despite the above disclosures in the art, there is a continuing need for the development or identification of perfumes suitable for use in liquid or gel bleaching compositions containing amidoperoxyacid bleach and which have good stability when in direct contact with such bleach.

SUMMARY OF THE INVENTION

The present invention relates to liquid or gel bleaching compositions comprising, by weight:

(a) from about 1% to about 40% of an amidoperoxyacid bleach of the formula:

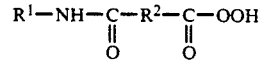

or

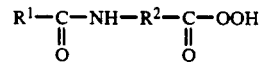

wherein $R^1$ is an alkyl group containing from about 6 to about 12 carbon atoms and $R^2$ is an alkylene group containing from 1 to about 6 carbon atoms, and (b) from about 0.01% to about 1% of a perfume comprising perfume ingredients selected from the group consisting of dodecahydrotetramethylnapthofuran, methyl-2,2-dimethylbicyclo-(2,2,1)-heptane-3-carboxylate, 4-isopropylbenzonitrile, 2-heptyltetrahydrofuran, 2-methyldecanonitrile, 3,5,5-trimethylhexylacetate, 2-4-dimethyl-6-phenyldihydropyran, 2,4,dimethyl-4-phenyl tetrahydrofuran, 5-acetyl-3-isopropyl-1,1,2,6-tetramethylindane, phenylethyl iso-pentyl-ether, phenylethyl n-butyl ether, 3-methyldodecanonitrile, 2-tertiarybutylcyclohexyl acetate, tridecene-2-nitrile, amyl salicylate, fenchyl alcohol, iso bornyl acetate, 2-methyl-3-(2-pentenyl)-2-cyclopenten-1-one, methyl cedrylone, bicyclo(2,2,1)heptane,2-ethyl-5-methoxy, Cistus Biocolorless, 3-cyclopentene-1-acetonitrile,2,2,3-trimethyl, cyclohexanepropanol,2,2,6-trimethyl-alpha-propyl, and 1,3-dioxolane,2-hexyl, and mixtures thereof, wherein said perfume is in direct contact with said amidoperoxyacid bleach, and said composition has a pH of from about 2.5 to about 6.5 at 20° C.

DETAILED DESCRIPTION OF THE INVENTION

The liquid or gel bleaching compositions of the present invention comprise amidoperoxyacid bleach and selected perfume ingredients that have good stability when in direct contact with the bleach, such as happens when a perfume containing one or more of the perfume ingredients is sprayed directly onto or mixed into the composition containing the bleach. In addition to good perfume stability, the present compositions have improved amidoperoxyacid bleach stability due to the low reactivity with the perfume ingredients.

Compositions of the present invention are useful for bleaching fabrics, hard surfaces and other substrates. Preferred compositions herein exhibit good physical, chemical and rheological stability. They preferably have a viscosity of from about 10 to about 1000, preferably from about 50 to about 800, most preferably from 80 to 450, cps at 20° C. Viscosity is measured by an RVT Brookfield Viscometer using a No. 3 spindle and a setting of 100 rpm. Low viscosity is desirable for convenient pouring of the product from a container.

The present compositions can be used in conjunction with a separate cleaning composition such as a laundry detergent composition separately added to a laundering solution, e.g. in the washing machine. They can alternatively be used as an element of a laundry detergent or cleaning composition.

The liquid or gel bleaching compositions of the present invention comprise from about 1% to about 40%, preferably from about 2% to about 30%, more preferably from about 3% to about 20%, by weight of an amidoperoxyacid bleach of the formula

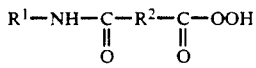

or

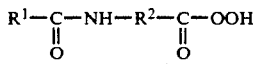

wherein $R^1$ is an alkyl group containing from about 6 to about 12 carbon atoms, and $R^2$ is an alkylene containing from 1 to about 6 carbon atoms. Preferably, $R^1$ is an alkyl group containing from about 8 to about 10 carbon atoms, and $R^2$ is an alkylene group containing from about 2 to about 4. Fully formulated liquid bleaches herein preferably contain from about 5% to about 20%, more preferably from about 7% to about 15%, by weight of the amidoperoxyacid bleach. Gel compositions herein typically contain higher levels of the bleach.

A preferred amidoperoxyacid herein is the monononylamide of peroxysuccinic acid ("NAPSA"). Most preferred is the monononylamide of peroxyadipic acid ("NAPAA"). Another name for NAPAA is 6-(nonylamino)-6-oxo-caproic acid. The chemical formula for NAPAA is:

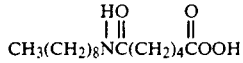

The molecular weight of NAPAA is 287.4.

Example I of U.S. Pat. No. 4,686,063 contains a description of the synthesis of NAPSA, from column 8, line 40 to Column 9, line 5, and NAPAA, from column 9, line 15 to column 9, line 65. At the end of the amidoperoxyacid synthesis, the reaction is quenched with water, filtered, washed with water to remove some excess sulfuric acid (or other strong acid with which the peroxyacid was made), and filtered again.

The amidoperoxyacid wet cake thus obtained is contacted with a phosphate buffer solution at a pH between about 3.5 and 6, preferably between about 4 and 5, according to U.S. Pat. No. 4,909,953, Sadlowski et al, issued Mar. 20, 1990, which is incorporated herein by reference.

Other agents for storage stabilization or exotherm control can be added to the amidoperoxyacid before incorporation into the final product. For example, boric acid, an exotherm control agent disclosed in U.S. Pat. No. 4,686,063, Burns, issued Aug. 11, 1987 and incorporated herein, can be mixed with the amidoperoxyacid (which has been washed in phosphate buffer) in about a 2:1 peracid:boric acid ratio. The phosphate buffer washed amidoperoxyacid can also be mixed with appropriate amounts of dipicolinic acid and tetrasodium pyrophosphate, a chelating stabilization system. Chelants can optionally be included in the phosphate buffer before contact with the wet cake.

NAPAA can be prepared by, for example, first reacting NAAA (monononyl amide of adipic acid), sulfuric acid, and hydrogen peroxide. The reaction product is quenched by addition to ice water followed by filtration, washing with distilled water, and final suction filtration to recover the wet cake. Washing can be continued until the pH of the filtrate is neutral.

Small particle size NAPAA agglomerates are desired herein to increase the amount of effective bleach which is in the wash solution and thereby improve bleaching/cleaning of fabrics in the wash. This is particularly useful in a hard water wash, i.e. wash water with more than about 6 grains of hardness, because hardness, specifically calcium ions, has been seen to interfere with available oxygen (AvO) from NAPAA with larger particle size. While not meaning to be bound by theory, it is believed that the calcium ions in the hard water surround large NAPAA particles, i.e. greater than about 300 microns, and interfere with the dissolution of the NAPAA, and that the smaller (about 0.1–260 microns) NAPAA particles dissolve rapidly in the wash water with minimal interference from the hardness ions. Small NAPAA particles are preferably recovered by quenching in water with high shear applied, e.g. rapid stirring, during addition of the NAPAA solution to water. Other known means of achieving small particle size may be used as appropriate. The NAPAA is then rinsed with water to remove excess sulfuric acid.

The average particle size of the NAPAA (or NAPSA) herein is 0.1 to 260 microns and is in large part a function of the amount of shear applied. The average particle size is preferably from about 10 to 100 microns, and most preferably from about 30 to about 60 microns.

NAPAA filter cake herein is preferably washed twice in phosphate buffer. It has been found that two successive phosphate buffer washes lend optimal stability to NAPAA. It is also highly preferred that the NAPAA pH (10% solids in water) be between about 4.2 and 4.75. Surprisingly, this pH results in more thermally stable particles.

Preferred NAPAA is thermally annealed, meaning that it has been heated up to 70° C. and then quenched and filtered. This process causes NAPAA to grow into a new crystal morphology. These new NAPAA crystals are sheared to an average particle size about 30–60 microns and are less readily soluble in the bleach product, thus resulting in more stable product rheology.

Parciculate (solid), organic peroxyacids with a theoretical AvO (available oxygen) of between about 3 and about 12, most preferably between 5 and 7, are preferred.

Perfume Ingredients

The compositions of the present invention also comprise from about 0.01% to about 1%, preferably from about 0.05% to about 0.5%, preferably from about 0.1% to about 0.3%, by weight of a perfume comprising perfume ingredients selected from the group consisting of dodecahydrotetramethylnapthofuran, methyl-2,2-dimethylbicyclo-(2,2,1)-heptane-3-carboxylate, 4-isopropylbenzonitrile, 2-heptyltetrahydrofuran, 2-methyldecanonitrile, 3,5,5-trimethylhexylacetate, 2-4-dimethyl-6-phenyldihydropyran, 2,4,dimethyl-4-phenyl tetrahydrofuran, 5-acetyl-3-isopropyl-1,1,2,6-tetramethylindane, phenylethyl iso-pentyl-ether, phenylethyl n-butyl ether, 3-methyldodecanonitrile, 2-tertiary-butylcyclohexyl acetate, tridecene-2-nitrile, amyl salicylate, fenchyl alcohol, iso bornyl acetate, 2-methyl-3-(2-pentenyl)-2-cyclopenten-1-one, methyl cedrylone, bicyclo(2,2,1)heptane,2-ethyl-5-methoxy, Cistus Biocolorless (a natural extract available from Biolandes Technologies), 3-cyclopentene-1-acetonitrile,2,2,3-trimethyl, cyclohexanepropanol,2,2,6-trimethyl-alpha-propyl, and 1,3-dioxolane,2-hexyl. The above perfume ingredients have a stability grade of 7B or higher after one month, as described in Example VII.

Particularly preferred perfumes herein comprise perfume ingredients selected from the group consisting of methyl-2,2-dimethylbicyclo-(2.2.1)-heptane-3-carboxylate, 4-isopropylbenzonitrile, 2-heptyltetrahydrofuran, 2-methyl-decanonitrile, 3,5,5-trimethylhexylacetate, 2-4-dimethyl-6-phenyldihydropyran, 2,4,dimethyl-4-phenyl tetrahydrofuran, phenylethyl iso-pentyl-ether, phenylethyl n-butyl ether, 3-methyldodecanonitrile, 2-tertiary-butylcyclohexyl acetate, tridecene-2-nitrile, amyl salicylate, fenchyl alcohol, iso bornyl acetate, methyl cedrylone, bicyclo(2,2,1) heptane,2-ethyl-5-methoxy, Cistus Biocolorless, and cyclohexanepropanol,2,2,6-trimethyl-alpha-propyl. These ingredients have a stability grade of BA or higher after one month, as described in Example VII.

Of the above, particularly preferred perfume ingredients include 4-isopropylbenzonitrile, 2-methyl-decanonitrile, 2-4-dimethyl-6-phenyldihydropyran, 2,4,dimethyl-4-phenyl tetrahydrofuran, phenylethyl n-butyl ether, 3-methyldodecanonitrile, tridecene-2-nitrile, fenchyl alcohol, iso bornyl acetate, bicyclo(2,2,1) heptane,2-ethyl-5-methoxy, Cistus Biocolorless, and cyclohexanepropanol,2,2,6-trimethyl-alpha-propyl. These ingredients have a stability grade of 9A after one month, as described in Example VII.

Particularly preferred perfumes herein comprise at least about 30%, preferably at least about 40%, and more preferably at least about 50% by weight of the above stable perfume ingredients.

Optional Ingredients

The bleach compositions herein can contain any of the optional ingredients known for use in such compositions. The balance of the composition should be water, preferably distilled and deionized water. Water containing heavy metals is undesirable because peroxyacids exposed to metals are subject to the loss of available oxygen and will lose bleaching activity. Preferably, the compositions contain from about 20 to about 90, preferably from about 40 to about 80, weight % of water.

The compositions of this invention preferably also include from about 0.1 to 40 weight % bleach-stable detergent surfactant selected from the group consisting of anionics, nonionics, zwitterionics and ampholytics and combinations thereof. From about 0.2 to 20 weight % bleach-stable detergent surfactant is preferred, and about 0.5 to 2 weight % is most preferred. Anionic surfactant is preferred and salts of $C_{11-13}$ linear alkyl benzene sulfonate and/or $C_{12-16}$ alkyl sulfate are more preferred. Sodium $C_{12-13}$ linear alkyl benzene sulfonate is most preferred.

Detergent surfactants useful herein are listed in U.S. Pat. Nos. 3,664,961, Norris, issued May 23, 1972, and 3,919,678, Laughlin et al, issued Dec. 30, 1975, both incorporated herein by reference. The following are representative examples of detergent surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched configuration, with from 3 to 12 moles of ethylene oxide per mole of alkyl phenol.

Preferred nonionics are the water-soluble and water-dispersible condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

The compositions herein preferably contain from about 3 to about 30, preferably from about 5 to about 25, most preferably from 7 to 15, weight % of alkali metal and alkaline earth salts of sulfate, nitrate, and/ or borate. Preferred are magnesium, sodium and/or potassium sulfate and/or borate. More preferred are magnesium sulfate, sodium sulfate and/or potassium sulfate. From 5 to 10 weight % of sodium sulfate and from 3 to 6 weight % of magnesium sulfate are highly preferred (calculated from the anhydrous weight).

These electrolytes are believed to improve the physical and chemical stability of the composition. Hydrate forming neutral salts desensitize peroxycarboxylic acids upon spillage and/or drying. Thus the safety during handling and marketing is increased. Magnesium sulfate in particular is added for safety since it may function as an exotherm control agent. The salt(s) o will increase the density of the aqueous liquid compositions herein, and may act as dispersing agent(s).

The salt(s) can be mixed into the composition in any order of addition, preferably after the water, peroxyacid, surfactant and chelant are mixed together. The salt(s) should be substantially solubilized or dissolved into the composition.

Preferred compositions of the present invention are aqueous liquid bleach compositions which contain solid, substantially water-insoluble organic peroxyacid, bleach-stable, stilbene fluorescent whitening agent (FWA), and polyvinyl pyrrolidone (PVP) or polyvinyl alcohol (PVA) for an enhanced whitening and brightening effect. The ratio of PVP:FWA is between about 100:1 and about 1:1, the ratio of PVA:FWA is between about 20:1 and about 1:1, and the compositions have a pH of from about 1 to about 6.5.

The PVP:FWA ratio in the present composition is between about 100:1 and about 1:1, preferably between about 20:1 and about 1:1, most preferably between 10:1 and 3:1. The PVA:FWA ratio in the present composition is between about 20:1 and about 1:10, preferably between about 10:1 and about 1:5, most preferably between 3:1 and 1:3.

The present compositions preferably contain from about 0.2 to about 20, preferably from about 0.4 to about 10, more preferably from about 0.5 to about 5, most preferably from 1 to 2, weight % polyvinyl pyrrolidone (preferred) and/or polyvinyl alcohol. The PVP, which includes substituted and unsubstituted vinyl pyrrolidone polymerization products, and PVA have a molecular weight between about 4,000 and about 200,000, preferably between about 5,000 and about 100,000, most preferably between 10,000 and 30,000.

PVP is most preferred in the liquid bleach composition. A combination of PVPs and/or PVAs of different molecular weights could also be used. The minimum amount of PVP/PVA which will achieve the benefit should be used since excess PVP/PVA can result in redeposition on the fabric. Generally, the higher the molecular weight of the PVP/PVA is, the less PVP/PVA is needed. The amount of PVP/PVA used also depends upon the FWA used.

The PVP and/or PVA are preferably incorporated into the composition by mixing into the formula with mechanical agitation until substantially dispersed.

A preferred ingredient is from about 0.05 to about 3, more preferably from about 0.1 to about 1, most preferably from 0.15 to 0.2, weight % of xanthan gum. Xanthan gum is a polysaccharide used herein as a dispersing agent and stabilizer. It is produced by fermentation and extraction of the naturally occurring plant bacteria, *Xanthomonas campestrias.*

Xanthan gum and surfactant in the present compositions, where alkali earth metal salts are included, allow the formulation of a product which shows surprising stability. In this preferred formulation, PVP is included, but PVA and cellulosic derivatives are not included. The compositions are storage-stable and pourable for months.

A preferred ingredient for use in the present compositions is from about 0.005 to about 1.0, preferably from about 0.01 to about 0.5, most preferably from 0.05 to 0.3, weight % of chelant. Chelants are added because the peroxyacids are subject to the loss of available oxygen when contacted by heavy metals.

Examples of suitable chelants for use herein are: carboxylates, such as ethylene diamine tetraacetate (EDTA) and diethylene triamine pentaacetate (DTPA); polyphosphates, such as sodium acid pyrophosphate (SAPP), tetrasodium pyrophosphate (TSPP), and sodium tripolyphosphate (STPP); phosphonates, such as ethylhydroxydiphosphonate (Dequest® 2010) and other sequestering agents sold under the Dequest® trade name; and combinations of the above. Other sequestering agents for use herein are dipicolinic acid (2,6 pyridinedicarboxylic acid), picolinic acid, and 8-hydroxyquinoline, and combinations thereof.

The chelating agent can be any of those described above or described in U.S. Pat. No. 3,442,937, issued May 6, 1969 to Sennewald et al., U.S. Pat. No. 2,838,459, issued Jul. 10, 1958 to Sprout, Jr., and U.S. Pat. No. 3,192,255, issued Jun. 29, 1965 to Cann, incorporated herein by reference. Preferred chelating agents are picolinic acid, dipicolinic acid, and ethylhydroxydiphosphonate.

Hydrotropes such as sodium, potassium, and ammonium xylene sulfonate, sodium, potassium and ammonium toluene sulfonate, sodium, potassium and ammonium cumene sulfonate, and mixtures thereof, and related compounds (as disclosed in U.S. Pat. No. 3,915,903, incorporated herein by reference) can be utilized in the interests of achieving a desired product phase stability and viscosity. Hydrotropes useful in the compositions of the present invention are typically present at levels of from about 0.5% to about 10%, preferably from about 1% to about 5%, by weight. Sodium toluene sulfonate is preferred.

The composition of the present invention has a pH at 20° C. of from about 2.5 to about 6.5, preferably from about 2.5 to about 5.5, most preferably from 3.5 to 4.5.

To obtain the desired product pH, conventional pH adjusting agents are used. From about 5 to about 20, preferably from 10 to 15, weight % of sodium hydroxide (calculated on a 0.5N basis) is preferred.

The bleach compositions herein preferably contain from about 0.01 to about 5, preferably from about 0.05 to about 2, most preferably from 0.1 to 1, weight % of bleach-stable, stilbene fluorescent whitening agent (FWA). Stilbene FWAs are aromatic compounds with two aryl groups separated by an alkene chain. They prefeably have the following structural formula:

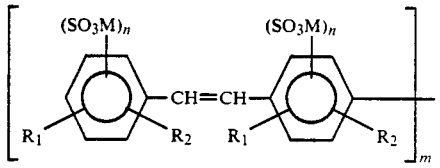

wherein $R_1$ is hydrogen, halogen, alkyl, alkoxy or phenyl;

$R_2$ is hydrogen or alkyl;

M is hydrogen, an alkali metal or ammonium ion;

n=0–2, but the formula must contain at least one $SO_3M$ group; and m=1–2 and when m=1, the substituent on the linkage carbon is hydrogen.

Suitable stilbene FWAs for use herein, if they are bleach-stable, are as described in U.S. Pat. Nos. 4,309,316 and 4,298,490, Lange et al, issued Jan. 5, 1982 and Nov. 3, 1981, respectively, both incorporated by reference, and U.S. Pat. No. 5,035,825, Eckhardt et al, issued Jul. 30, 1991, also incorporated herein by reference.

Bleach-stable anionic FWAs with sulfonic acid group(s) which work on cotton (cellulosics) are preferred.

The most preferred stilbene FWA for use herein, because it is bleach-stable, is Tinopal ® CBS-X, which is benzenesulfonic acid, 2,2'-((1,1'-biphenyl)-4,4'-diyldi-2,1-ethenediyl)bis-, disodium salt (CA Index Name). The formula for Tinopal ® CBS-X is:

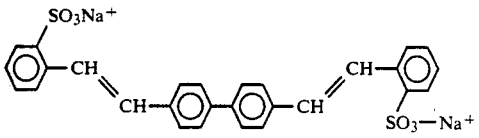

The FWA is preferably dissolved or dispersed in the liquid bleach composition, preferably after the peroxyacid and PVP or PVA is mixed into water.

Other desirable optional ingredients include bleach-stable enzymes and dyes and colorants. Chloride should be excluded from the compositions herein.

From about 0.01 to about 5, preferably from about 0.1 to about 2.5, weight % of bleach-stable enzymes are desirably included herein. Suitable enzymes include protease, lipase, amylase, cellulase, and mixtures thereof, which are commercially available.

The ingredients herein should be combined in any manner which will evenly disperse or dissolve them in the composition, and which does not interfere with their action. Preferably, the ingredients are added to a mixer while stirring. The preferred order of addition is: water, peroxyacid, chelant, surfactant, salts, hydrotrope, PVP, FWA, xanthan gum, pH adjusting agent, water to balance and perfume.

An aqueous liquid bleach composition which is physically, chemically and rheologically stable (preferred embodiment herein) can be formulated by including the following, by weight of the composition:

a. 0.05–3% xanthan gum;

b. 5–15% amidoperoxyacid of average particle size from about 30 to about 60 microns;

c. 0.2–1.5% nonionic or anionic surfactant;

d. 0.01–0.5% chelant;

e. 7–15% sodium sulfate and magnesium sulfate;

f. 1–5% hydrotrope;

g 0.5–5% PVP with molecular weight between 10,000 and 20,000;

h. 0.05–2% FWA Tinopal ® CBS-X of the formula:

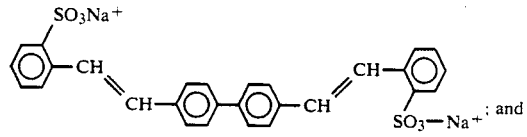

; and i. balance distilled deionized water; wherein the pH at 20° C. of the composition is between 3.5 and 4.5.

A sufficient amount of sodium hydroxide (0.5N) is added (usually 10–15 weight %) just before balancing with water to bring the pH of the composition at 20° C. to between 3.5 and 4.5 These ingredients should be mixed together in the above order of addition beginning with part of the water. PVA and cellulosic derivatives are preferably excluded, as is chloride.

The bleach additive herein can be used with a hard surface cleaning composition. Ordinarily, a conventional hard surface cleaner would be added at the recommended level to, for example, 2 gallons of water. From about 10 to about 100 milliliters of the bleach additive would then be added to the water, and the hard surface would be washed or scrubbed.

Bleaching compositions of the present invention are utilized by adding them to water in an amount sufficient to provide from about 1 ppm to 100 ppm, preferably from about 1 ppm to 20 ppm, of available oxygen in solution. Fabrics (or hard surfaces) to be bleached are then contacted with such aqueous bleaching solutions.

This invention further provides a method for cleaning and bleaching fabrics in the wash by contacting the fabrics with effective amounts of a detergent cleaning composition and an aqueous liquid bleach composition comprising, by weight:

(a) from about 1% to about 40% of solid, substantially water-insoluble organic peroxyacid;

(b) from about 0.2% to about 20% of polyvinyl pyrrolidone or polyvinyl alcohol with a molecular weight between about 4,000 and about 200,000;

(c) from about 0.01% to about 5% of bleach-stable, stilbene fluorescent whitening agent; and wherein the ratio of polyvinyl pyrollidone to fluorescent whitening agent is between about 100:1 and about 1:1, or the ratio of polyvinyl alcohol to fluorescent whitening agent is between about 20:1 and about 1:10; and the composition has a pH at 20° C. of from about 1 to about 6.5.

Preferably the aqueous liquid composition used in the preferred method for cleaning and bleach fabrics comprises ingredients a-i above. Agitation is preferably provided for enhanced bleaching.

The compositions of the present invention can be used in conjunction with conventional liquid or granular detergent compositions. Such compositions can contain standard detergent ingredients, such as the surfactants and builders described in U.S. Pat. No. 4,100,095, Hutchins et al., issued Jul. 11, 1978, incorporated herein by reference. Other detergent compositions that can be used with the compositions herein are described in U.S. Pat. No. 4,561,998, Wertz, et al., issued Dec. 31, 1985, U.S. Pat. No. 4,507,219, Hughes, issued Mar. 26, 1985, and U.S. Pat. No. 4,909,953, Sadlowski et al, issued Mar. 20, 1990, all incorporated herein by reference. Preferred fabric laundering granular detergent compositions are described in U.S. Pat. No. 4,909,953, column 8, lines 45-55 and U.S. Pat. No. 5,055,218, Getty et al, issued Oct. 8, 1991, columns 10-14, incorporated herein by reference.

Preferably, the detergent composition is used at its recommended level, usually ¼-1 cup for granular compositions. The bleach additive herein is preferably added to the wash at about the same time as the detergent is added. From about 10 to about 150, preferably about 50 to about 100, milliliters of bleach additive is added to about 18 gallons of wash water.

The following examples illustrate the compositions of the present invention, but are not necessarily meant to limit or otherwise define the scope of the invention.

All parts, percentages and ratios used herein are by weight unless otherwise specified.

EXAMPLE I

A freshly-prepared sample of NAPAA wet cake is typically about 60% water, about 2% peroxyacid available oxygen (AvO) (corresponding to about 36% NAPAA), and the rest (about 4%) unreacted starting material. This wet cake is the reaction product of NAAA (mononyl amide of adipic acid), sulfuric acid, and hydrogen peroxide. The crude reaction product from the chemical reaction is quenched by addition to water followed by filtration, washing with distilled water, phosphate buffer washing and final suction filtration to recover the wet cake. The wet cake is redispersed in a 1.7% phosphate buffer solution at a 5:1 buffer solution to NAPAA wet cake weight ratio. With stirring, the slurry is heated to 70° C. and held at 70° C. for 10 minutes before quenching with deionized distilled water to about 50° C. or lower. The thermally annealed NAPAA solid is then obtained by suction filtration.

EXAMPLE II

The following composition is prepared by high speed mixing, in a mixing vessel (4 L beaker), of the thermally annealed NAPAA (64% active) of Example I into water. The other components are added in the order listed and at the indicated time (approximate) after turning on the high speed mixer.

| Component | Gms | Weight % | Time |
|---|---|---|---|
| Distilled, deionized water | 1052 | 52.30 | 0 minutes |
| Thermally annealed NAPAA | 320 | 10.14 | 0 minutes |
| $C_{12-13}$ Linear alkylbenzene sulfonate | 20.83 | 1.0 | 1 minutes |
| 2,6 Pyridinedicarboxylic acid Sulfonic acid | 5.0 | 0.25 | 3 minutes |
| Sodium sulfate | 149.65 | 7.46 | 5 minutes |
| Magnesium sulfate *7 $H_2O$ | 133.50 | 3.26 | 20 minutes |
| Sodium toluene sulfonate | 34.62 | 1.61 | 25 minutes |
| Xanthan gum | 3.0 | 0.15 | 30 minutes |
| Polyvinyl pyrrolidone (MW 10,000) | 37.80 | 1.89 | 41 minutes |
| FWA (Tinopal ® CBS-X) | 2.0 | 0.1 | 42 minutes |

After 50 minutes, the pH of the composition is determined to be 2.3 at room temperature. Sodium hydroxide solution (0.5N) is added with stirring to adjust the pH to 4.5.

The slurry mix is then subjected to high shear mixing for 5 minutes. The pH is again determined to be 4.5 and the balance of water is added. The composition is a stable suspension of ingredients having a viscosity of 97 cps at room temperature and containing 9.71% NAPAA. The average particle size of NAPAA is determined to be about 34 microns.

EXAMPLE III

This experiment shows that panelists visually prefer liquid bleach samples containing polyvinyl pyrrolidone ("PVP") and bleach-stable, stilbene fluorescent whitening agent (FWA Tinopal ® CBS-X) for whiteness and brightness.

Five liquid bleach samples are prepared as follows.

| | Weight % |
|---|---|
| Water (distilled and deionized) | 20.00 |
| Mononnylamido peroxyadipic acid | 10.19 |
| $C_{12-13}$ Linear alkylbenzene sulfonic acid | 1.00 |
| 2,6-Pyridinedicarboxylic acid | 0.25 |
| Sodium sulfate | 8.30 |
| Magnesium sulfate *7 $H_2O$ | 7.41 |
| Sodium toluene sulfonate | 1.73 |

Components are added in the order shown above and mixed during addition using a mechanical mixer. The following ingredients are then added, while mixing, to the above formula:

Sample A=no PVP, no FWA

Sample B=1 wt. % PVP*

Sample C=0.1 wt. % FWA Tinopal ® CBS-X

Sample D=1 wt. % PVP*, 0.1 wt. % FWA Tinopal ® CBS-X

Sample E=1 wt. % PVP*, 0.1 wt. % FWA2**

*Molecular weight of 10,000

**FWA2 is Calcofluor ® White CG.

Each sample is pH adjusted to pH 4.5 using 0.5N sodium hydroxide. Water (distilled and deionized) is added while mixing to bring the total for each sample to 100 grams.

Each sample is then put in a vial and graded (unidentified) by 10 panelists. Panelists are asked to compare vial contents for whiteness and brightness and assign grades according to the following scale:

0=no difference between two samples
1=think there is a difference
2=know there is a little difference
3=know there is a lot of difference
4=know there is a whole lot of difference Each panelist grades under standard lighting and under ultraviolet (UV) lighting. Grades are then averaged and normalized.

Results: Results, which are zeroed to A (control), are as follows:

| Graph 1: Visual Preference in Standard Lighting | | | | |
|---|---|---|---|---|
| −4 | | 0 | | +4 |
| | −2.65 | −2.38 | .38 | 4.25 |
| | E | C | A B | D |
| Graph 2: Visual Preference in UV Lighting | | | | |
| 0 | 1 | 2 | 3 | 4 |
| .04 | .90 | | 3.34 | 4.10 |
| B | E | | C | D |

Conclusion: The results show that liquid bleach with PVP+FWA Tinopal® CBS-X (Sample D) is significantly whiter and brighter in standard lighting than liquid bleach with PVP alone (Sample B). Liquid bleach with FWA1 alone (Sample C) or PVP+FWA2 (Sample E) actually receive negative scores, indicating a lack of whiteness/brightness.

Scoring under ultraviolet lighting shows that liquid bleach with PVP+FWA Tinopal® CBS-X (Sample D) is brighter than the other samples, and that the three samples containing FWA (Samples C, D & E) are significantly brighter than the sample with PVP alone (Sample B).

Other ingredients which can be employed in liquid bleach can be substituted for or added to the above. For example, other peracid bleaches such mononononylamido peroxysuccinic acid ("NAPSA"), sulfone peroxyacids, and N-decanoyl-6-amino-peroxycaproic acid can be used. Any bleach-compatible surfactants can be substituted for the linear alkylbenzene sulfonic acid, such as sodium alkyl sulfate and sodium alkyl ethoxy sulfate. Surfactant and hydrotrope are optional in the formula. Other hydrotropes, such as sodium xylene sulfonate, can be used. Other chelants, such as diphosphonate, tetrasodium pyrophosphate, and ethylene diamine tetraacetate, can be substituted for the dipicolinic acid.

EXAMPLE IV

A composition of the present invention is prepared by mixing together the following ingredients in the order shown:

| Component | Weight % |
|---|---|
| Distilled, deionized water | 40.00 |
| Mononononylamido peroxyadipic acid | 10.19 |
| $C_{12-13}$ Linear alkylbenzene sulfonic acid | 1.00 |
| 2,6 Pyridinedicarboxylic acid | 0.25 |
| Sodium sulfate | 8.30 |
| Magnesium sulfate *7 $H_2O$ | 7.41 |
| Sodium toluene sulfonate | 1.73 |
| Polyvinyl pyrrolidone (MW 10,000) | 1.89 |
| FWA (Tinopal ® CBS-X) | 0.25 |
| Sodium hydroxide | 0.25 |

-continued

| Component | Weight % |
|---|---|
| Water, distilled and deionized | Balance |

EXAMPLE V

A composition of the present invention is prepared by mixing together the following ingredients in the order shown:

| Component | Weight % |
|---|---|
| Distilled, deionized water | 40.00 |
| Mononononylamido peroxyadipic acid (60% Active) | 16.92 |
| 2,6 Pyridinedicarboxylic acid | 0.24 |
| $C_{12-13}$ Linear alkylbenzene sulfonic acid | 1.01 |
| Sodium sulfate | 7.19 |
| Magnesium sulfate *7 $H_2O$ | 6.42 |
| Sodium toluene sulfonate | 1.67 |
| Polyvinyl pyrrolidone (MW 10,000) | 1.82 |
| FWA Tinopal ® CBS-X | 0.10 |
| Xanthan gum | 0.15 |
| Sodium hydroxide (2N) | 3.32 |
| Water, distilled and deionized | 21.16 |

100 ml of the above bleach composition is added to each load of laundry wash water, along the ½ cup (66.40 grams-dosage) of the following granular detergent composition.

| Component | Weight % |
|---|---|
| Sodium 12.3 linear alkyl benzene sulfonate | 12.60 |
| Sodium $C_{14}$-$C_{15}$ alkyl sulfate | 6.20 |
| Citric acid | 3.50 |
| Zeolite A, hydrate (1-10 micron size) | 26.30 |
| Sodium carbonate | 20.53 |
| Sodium silicate (1.6 ratio $NaO/SiO_2$) | 2.29 |
| Polyethylene glycol (MW 8,000) | 1.73 |
| Sodium polyacrylate (MW 4,500) | 3.39 |
| Protease enzyme* | 0.0164 |
| Sodium perborate monohydrate | 0.82 |
| Sodium sulfate | 10.33 |
| Balance (including water, brightener, perfume suds suppressor) | to 100.00 |

*Activity of 1.8 Anson units per gram.

Alternatively, 100 ml of the above bleach composition is added to each load of laundry wash water, along with ½ cup (131 grams) of the following liquid detergent composition.

| Component | Weight % |
|---|---|
| $C_{14-15}$ alkyl polyethoxylate (2.25) sulfonic acid | 8.43 |
| 1,2-Propanediol | 4.50 |
| Monoethanolamine | 1.05 |
| $C_{12-13}$ alcohol polyethoxylate (6.5)* | 3.37 |
| $C_{13}$ linear alkylbenzene sulfonic acid | 8.43 |
| Ethanol | 1.18 |
| Sodium hydroxide | 3.30 |
| Sodium toluene sulfonate | 2.91 |
| $C_{12-14}$ fatty acid | 0.50 |
| Citric acid | 3.37 |
| Sodium/calcium formate | 0.41 |
| $C_{12}$ alkyltrimethylammonium chloride | 0.51 |
| Tartrate succinate** | 3.37 |
| TEPA-$E_{15-18}$*** | 1.48 |
| Protease enzyme | 0.0076 AU/g |

-continued

| Component | Weight % |
|---|---|
| Water, brightener, perfume and minors | to 100.00 |

*Alcohol and monoethoxylated alcohol removed.
**80:20 mix of TMS:TDS per U.S. Pat. No. 4,663,071.
***Tetraethylene pentaimine ethoxylated with 15-18 moles (avg.) of ethylene oxide at each hydrogen site on each nitrogen.

EXAMPLE VI

A bleach composition of the present invention with PVA & FWA is as follows.

| Component | Weight % |
|---|---|
| Distilled, dionized water | 40.00 |
| Mononnylamido peroxyadipic acid | 20.40 |
| 2,6-Pyridinedicarboxylic acid | 0.25 |
| Sodium sulfate | 8.30 |
| Magnesium sulfate *7 $H_2O$ | 7.41 |
| Sodium toluene sulfonate | 1.73 |
| $C_{12-13}$ Linear alkylbenzene sulfonic acid | 1.00 |
| Xanthan gum | 0.15 |
| Polyvinyl pyrrolidone (MW 10,000) | 1.89 |
| FWA (Tinopal ® CBS-X) | 0.10 |
| Sodium hydroxide | 0.50 |
| Water, distilled and deionized | Balance |

EXAMPLE VII

Perfume ingredients are evaluated for stability when in direct contact with an unperfumed bleach composition of Example IV, using the following method.

(1) 25 g of the unperfumed bleach composition containing NAPAA is weighed into a 2 oz capacity screw-cap plastic bottle.

(2) 0.05 g (±0.005 g) of perfume ingredient is dropped into the product from a disposable pipette to give a perfume level of 0.2% (±0.02%).

(3) The bottle is then capped and shaken vigorously for ten to fifteen seconds.

(4) After storage at room temperature, the samples are evaluated by an expert perfumer using the following scales for perfume intensity and character.

Perfume Intensity Scale

1 = there is no perfume
2,3 = I think there is no perfume
4,5 = I think there is perfume
6 = there is perfume
7,8,9 = there is a strong perfume (where 9 = the strongest)

Perfume Character Scale

A = indistinguishable from fresh perfume character as applied to product
B = slightly different from fresh perfume character
C = obviously changed from fresh perfume character, but still usable
D = different from fresh perfume character, not usable.

The results are as follows.

| Perfume Ingredient | 1 Month Stability Grade |
|---|---|
| dodecahydrotetramethylnapthofuran (50% in Shellsol T) | 7A |
| methyl-2,2-dimethylbicyclo-(2.2.1)-heptane-3-carboxylate | 9C |
| 4-isopropylbenzonitrile | 9A |
| 2-heptyltetrahydrofuran | 8A |
| 2-methyl-decanonitrile | 9A |
| 3,5,5-trimethylhexylacetate | 8A |
| 2-4-dimethyl-6-phenyldihydropyran | 9A |
| 2,4,dimethyl-4-phenyl tetrahydrofuran | 9A |
| 5-acetyl-3-isopropyl-1,1,2,6-tetramethylindane | 7A |
| phenylethyl iso-pentyl-ether | 9B |
| phenylethyl n-butyl ether | 9A |
| 1-ethoxy-1-phenylethoxy ethane | * |
| 3-methyldodecanonitrile | 9A |
| N-methyl-N-phenyl-2-methyl butyramide | 6A |
| 2-tertiary-butylcyclohexyl acetate | 9B |
| tridecene-2-nitrile | 9A |
| amyl salicylate | 8A |
| fenchyl alcohol | 9A |
| iso bornyl acetate | 9A |
| 2-methyl-3-(2-pentenyl)-2-cyclopenten-1-one | 8B |
| methyl cedrylone | 8A |
| bicyclo(2,2,1)heptane,2-ethyl-5-methoxy | 9A |
| Cistus Biocolorless | 9A |
| 3-cyclopentene-1-acetonitrile, 2,2,3-trimethyl | 7B |
| cyclohexanepropanol,2,2,6-trimethyl-alpha-propyl, | 9A |
| 1,3-dioxolane,2-hexyl | 8B |

*Test discontinued after 1 week because of grade of 7D.

EXAMPLE VIII

A perfume composition is as follows:

| Ingredient | Wt. % |
|---|---|
| amy salicylate | 43.00 |
| fenchyl alcohol | 1.00 |
| iso bornyl acetate | 20.00 |
| 2-methyl-3-(2-pentenyl)-2-cyclopenten-1-one | 1.00 |
| methyl cedrylone | 30.00 |
| sino citryl (compounded specialty perfume) | 5.00 |
| Total | 100.00 |

The above perfume composition, which contains 95% by weight of perfume ingredients having a stability grade of 7A or higher after one month, and 94% by weight of ingredients having a stability grade of 8A or higher after one month, as described in Example VII, is mixed at a level of 0.2% by weight directly into the liquid bleaching composition of Example V to provide a perfumed composition of the present invention.

What is claimed is:

1. A liquid or gel bleaching composition comprising, by weight:

(a) from about 1% to about 40% of an aqueous amidoperoxyacid bleach which is the mononnylamide of peroxyadipic acid, and (b) from about 0.1% to about 1% or a perfume comprising perfume ingredients selected from the group consisting of methyl-2,2-dimethylbicyclo-(2,2,1)-heptane-3-carboxylate, 4-isopropylbenzonitrile, 2-heptyltetrahydrofuran, 3,5,5-trimethylhexylacetate, 2-4-dimethyl-6-phenyldihydropyran, 2-4,dimethyl-4-phenyltetrahydrofuran, 5-acetyl-3-isopropyl-1,1,2,6,tetramethylindane, phenylethyl n-butyl ether, tridecene-2-nitrile, fenchyl alcohol, iso bornyl acetate, 2-methyl-3-(2-pentenyl)-2-cyclopenten-1-one, methyl cedrylone, bicyclo(2,2,1)heptane, 2-ethyl-5-methoxy, 3-cyclopentene-1-acetonitrile-2,2,2-trimethyl, cyclohexanepropanol, 2,2,6-trimethlyalpha-propyl, and 1,3-dioxolane, 2-hexyl, and mixtures thereof, wherein said perfume is in direct contact with said amidoperoxyacid bleach, and said composition has a pH of from about 2.5 to about 6.5 at 20° C.

2. A composition according to claim 1 wherein the perfume ingredients are selected from the group consisting of methyl-2,2-dimethylbicyclo-(2,2,2)-heptane-3-carboxylate, 4-isopropylbenzonitrile, 2-heptyltetrahydrofuran, 3,5,5-trimethylhexylacetate, 2-4-dimethyl-6-phenyl-dihydropyran, 2,4,dimethyl-4-phenyl tetrahydrofuran, tridecene-2-nitrile, fenchyl alcohol, iso bornyl acetate, methyl cedrylone, bicyclo(2,2,1)heptane,2-ethyl-5-methoxy, and cyclohexanepropanol,2,2,6-trimethyl-alpha-propyl.

3. A composition according to claim 2 wherein the perfume ingredients are selected from the group consisting of 4-isopropylbenzonitrile, 2-4-dimethyl-6-phenyldihydropyran, 2,4,dimethyl-4-phenyl tetrahydrofuran, tridecene-2-nitrile, fenchyl alcohol, iso bornyl acetate, bicyclo(2,2,1) heptane,2-ethyl-5-methoxy, and cyclohexanepropanol,2,2,6-trimethyl-alpha-propyl.

4. A composition according to claim 1 wherein the perfume comprises at least 30% by weight of the perfume ingredients selected from the group consisting of methyl-2,2-dimethylbicyclo-(2,2,1)-heptane-3-carboxylate, 4-isopropylbenzonitrile, 2-heptyl-tetrahydrofuran, 3,5,5-trimethylhexyl-acetate, 2-4-dimethyl-6-phenyldihydropyran, 2,4,dimethyl-4-phenyl tetrahydrofuran, tridecene-2-nitrile, fenchyl alcohol, iso bornyl acetate, methyl cedrylone, bicyclo(2,2,1)heptane,2-ethyl-5-methoxy, and cyclohexanepropanol,2,-2,6-trimethyl-alpha-propyl.

5. A composition according to claim 3 wherein the perfume comprises at least 30% by weight of perfume ingredients selected from the group consisting of 4-isopropylbenzonitrile, 2-4-dimethyl-6-phenyldihydropyran, 2,4,dimethyl-4-phenyl tetrahydrofuran, tridecene-2-nitrile, fenchyl alcohol, iso bornyl acetate, bicyclo(2,2,1) heptane,2-ethyl-5-methoxy, and cyclohexanepropanol,2,2,6-trimethyl-alpha-propyl.

6. A composition according to claim 5 wherein the perfume comprises at least 50% by weight of perfume ingredients selected from the group consisting of 4-isopropylbenzonitrile, 2-4-dimethyl-6-phenyldihydropyran, 2,4-dimethyl-4-phenyl tetrahydrofuran, tridecene-2-nitrile, fenchyl alcohol, iso bornyl acetate, bicyclo(2,2,1) heptane,2-ethyl-5-methoxy, and cyclohexanepropanol,2,2,6-trimethyl-alpha-propyl.

7. A composition according to claim 1 comprising from about 7% to about 15% by weight of the amidoperoxyacid bleach and from about 0.1% to about 0.3% by weight of the perfume.

* * * * *